United States Patent [19]

Cadwell

[11] Patent Number: 4,667,115

[45] Date of Patent: May 19, 1987

[54] ENERGY MACHINE GENERATING HYDRAULIC ENERGY

[76] Inventor: Calvin L. Cadwell, Rte. 1, Box 168-G, Bay City, Tex. 77414

[21] Appl. No.: 877,788

[22] Filed: Jun. 24, 1986

[51] Int. Cl.[4] ..... F03B 13/00

[52] U.S. Cl. ..... 290/54; 415/DIG. 2; 74/DIG. 9

[58] Field of Search ..... 415/DIG. 2; 74/DIG. 9; 290/54

*Primary Examiner*—William M. Shoop, Jr.
*Assistant Examiner*—Sharon D. Logan

[57] ABSTRACT

An energy machine generating hydraulic energy by the use of a plurality of wheels driven around a table surface, each wheel operating in turn a lever for operating a double acting hydraulic piston for producing output hydraulic energy.

11 Claims, 4 Drawing Figures

ENERGY MACHINE GENERATING HYDRAULIC ENERGY

BACKGROUND OF THE INVENTION

1. Field of Invention

The invention is an improved hydraulic pump which applies electrical energy, air pressure, centrifugal force and gravity to produce hydraulic pressure at low energy expenditure. It is a device which has a plurality of wheels driven by an electric motor which rotates the wheels along a table surface, the surface of which is slotted, and in such slots are located a plurality of levers which, when rolled across, activate a double acting hydraulic piston which produces hydraulic pressure. By the use of air pressure which is applied to a lever attached to the revolving wheels, the effect of centrifugal force and additional weight are applied to the wheels, causing a pressure output at low energy expense.

2. Description of the Prior Art

Various prior art of wheels and levers and hydraulic cylinders and the like devices, are well known, as well as apparatus and method of their contruction in general, are found to be known.

These well known prior uses teach and disclose various types of mechanical arrangements of devices of sorts and of various manufactures and the like as well as methods of their construction, but none of them whether taken singly or in combination disclose the specific details of the combination of the invention in such a way as to bear upon the claims of the present invention.

SUMMARY OF THE INVENTION

An object, advantage and feature of the invention is to provide a novel method of producing hydraulic pressure with minimum energy output.

Another object of the invention is to combine air pressure, centrifugal force, mechanical levers and electrical energy to produce a constant source of hydraulic pressure.

These, together with other objects and advantages which will become subsequently apparent, reside in the details of the process and operation thereof as more fully hereinafter is described and claimed, reference being had to the accompanying drawings forming a part hereof, wherein like numbers refer to like parts throughout.

DESCRIPTION OF THE SEVERAL VIEWS OF THE MACHINE ON THE ATTACHED DRAWINGS

FIG. 1—is a side view of the machine showing the three operating levels of the machine and a typical installation of the levers, wheels and electric motor in the preferred embodiment and the best mode of operation of the machine.

FIG. 2—is a top view of the machine showing the direction of rotation and the location of the hydraulic reservoir and the energy output location.

FIG. 3—is a detail drawing of the double action pump and "S" configured lever assembly showing the movement of the lever as the wheel passes along the track, activating the double action hydraulic pump.

FIG. 4—is a detail drawing of the wheel and lever assembly showing the hinge and bar assembly as well as the lever and air pressure plunger assembly which generates the leverage to increase the pressure on the wheels.

DESCRIPTION OF A PREFERRED EMBODIMENT OF THE INVENTION

Figure 1:
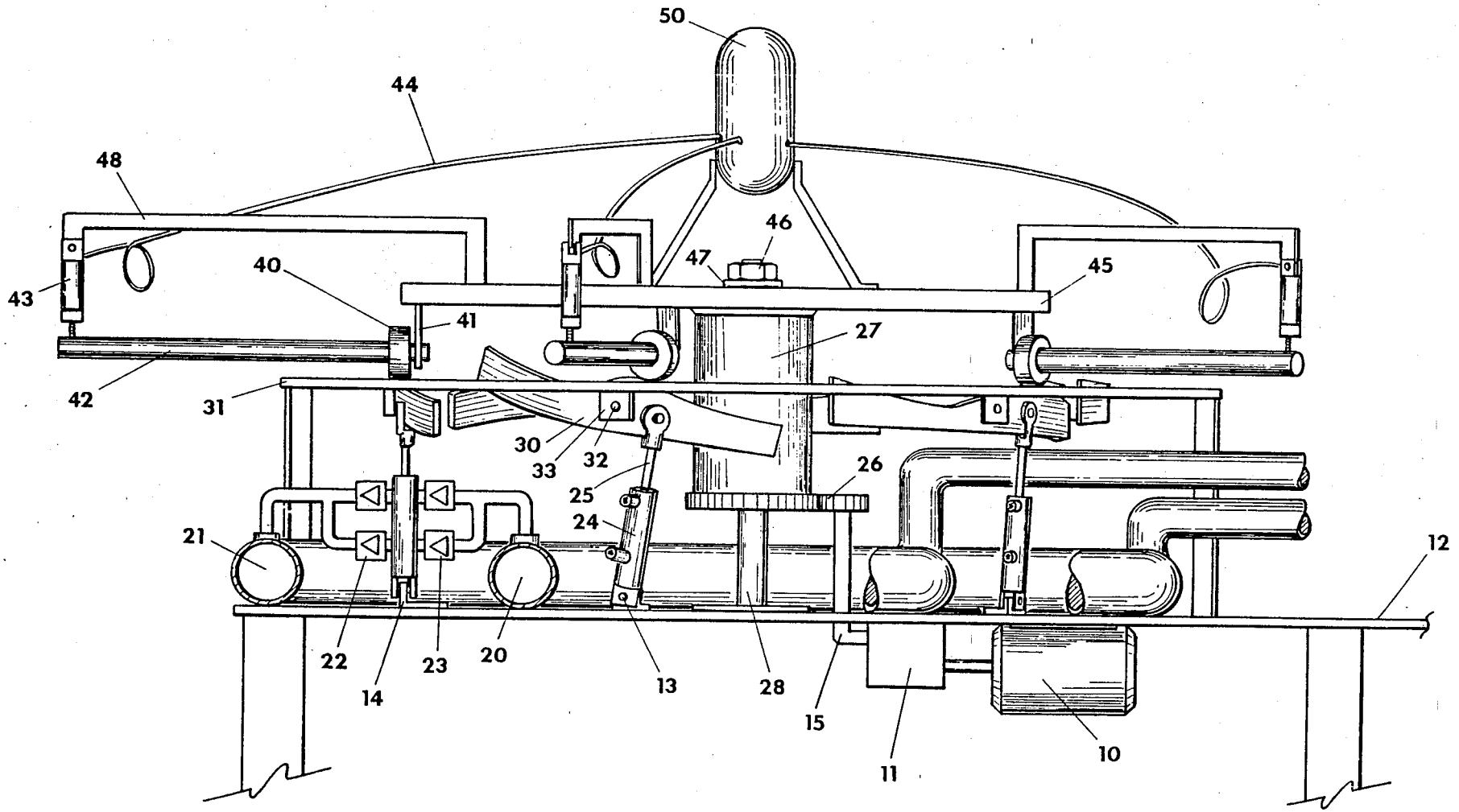

Referring now to the drawings, as shown on FIG. 1, there are three major operating areas of the machine designed to combined electrical, centrifugal, and mechanical energy to produce hydraulic pressure. These three levels consist of the energy input level, the energy output level and the rotary table assembly. In the energy input area, an electric motor (10) is mounted to the underside of a stationary table (12), and is mechanically connected to a gear box (11) which turns shaft (15) in either clockwise or counter-clockwise rotation. For the purposes of describing the action of the machine, we may assume only one direction of rotation. By the use of the gears (26), such shaft rotates shaft and housing (27) which is mounted on stationary table (12), which is mounted on non-rotating shaft (28) and supported by ball bearings (not shown) in such a manner as to allow it to freely rotate, and extends through an opening in stationary table (31) and is connected to rotary table (45) by a thrust bearing (47) and lock nut (46) assembly in such a manner so as to allow rotary table (45) to rotate in the same direction as shaft and housing (27).

Figure 2:
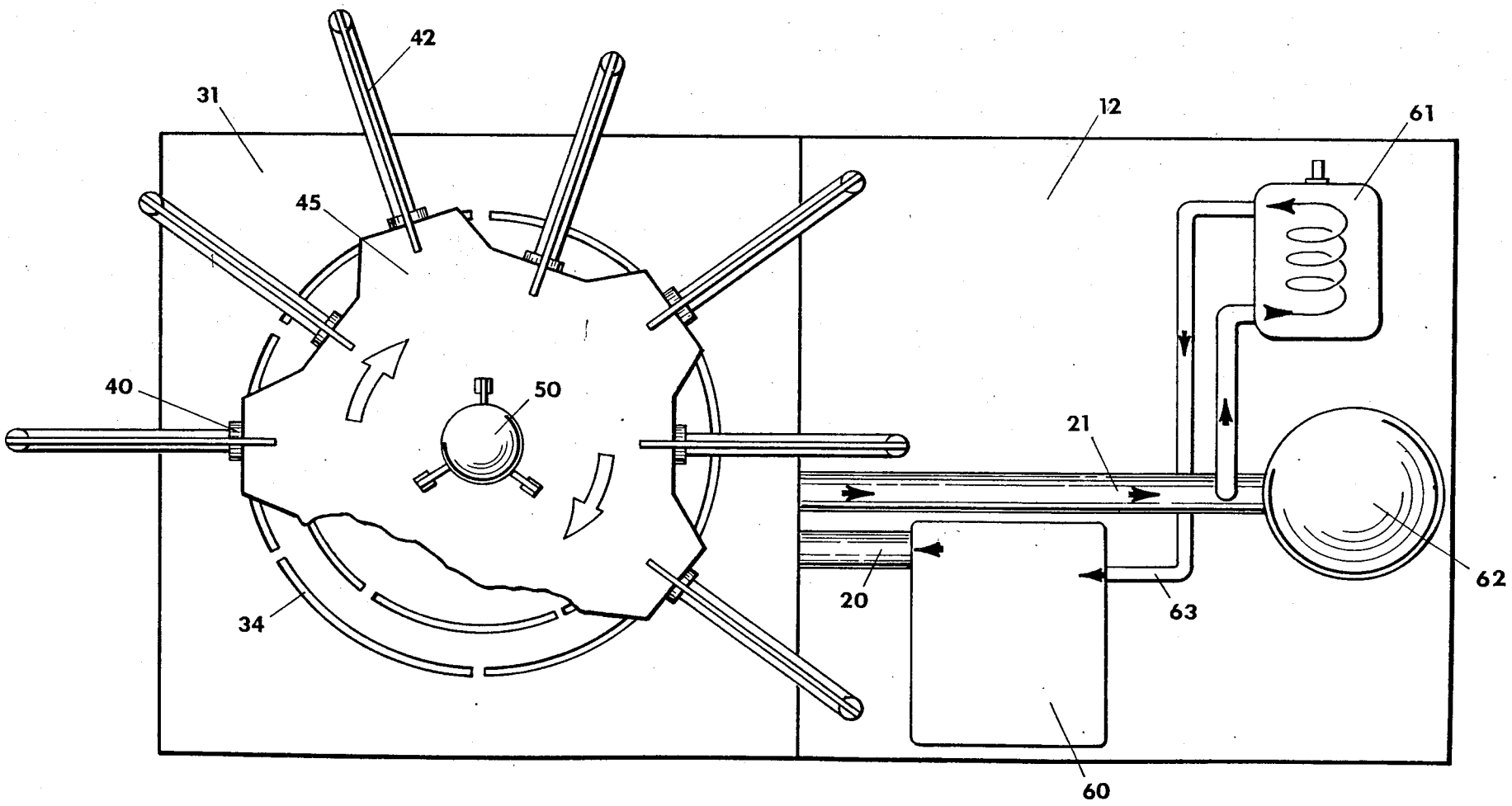
Figure 3:
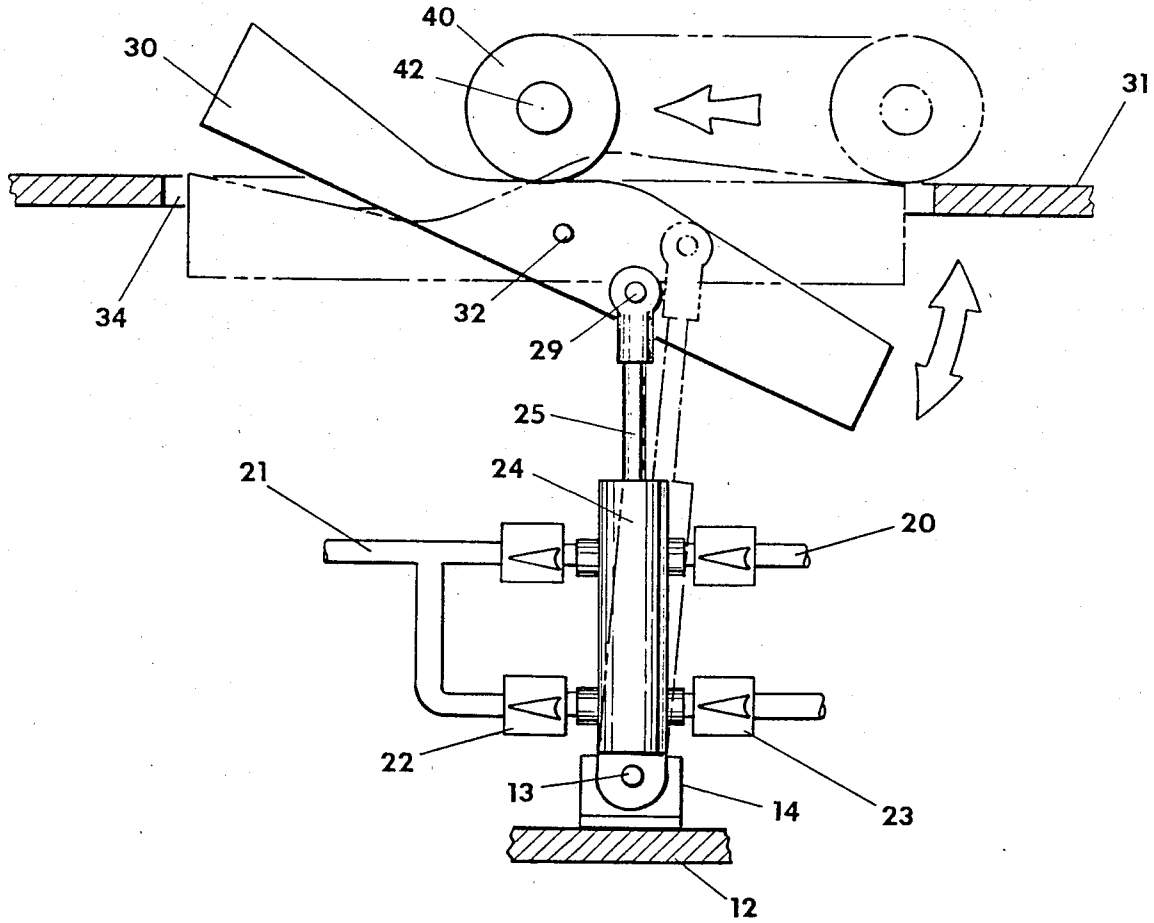

The second level of operation or the energy output level consists of the equipment located between the two stationary tables (12) and (31). Numerous double action hydraulic pumps (24) are mounted in a circular pattern on table (12) by the use of a welded angle iron bracket (14) and pin assembly (13) in such a manner that as the machine operates, the pumps may move independently in a generally "rocking motion". Hydraulic fluid is obtained from a reservoir (60 on FIG. 2) by use of piping (20) to enter the pumps (24) by open check valves (23). As the pumps operate, the fluid is passed through the open check valves (22), into a hydraulic collector channel (21) to the hydraulic reservoir (60 on FIG. 2), thus completing the circuit. The hydraulic pumps are operated in an up and down manner by the plunger (25) which is mechanically attached by a pin assembly (29) to an "S" configured lever (30) which extends through an opening (34 on FIG. 3) in stationary table (31), such lever (30) being also attached to table (31) by a bracket (33) and pin (32) assembly which allowsit to freely operate in an up and down manner.

Figure 4:
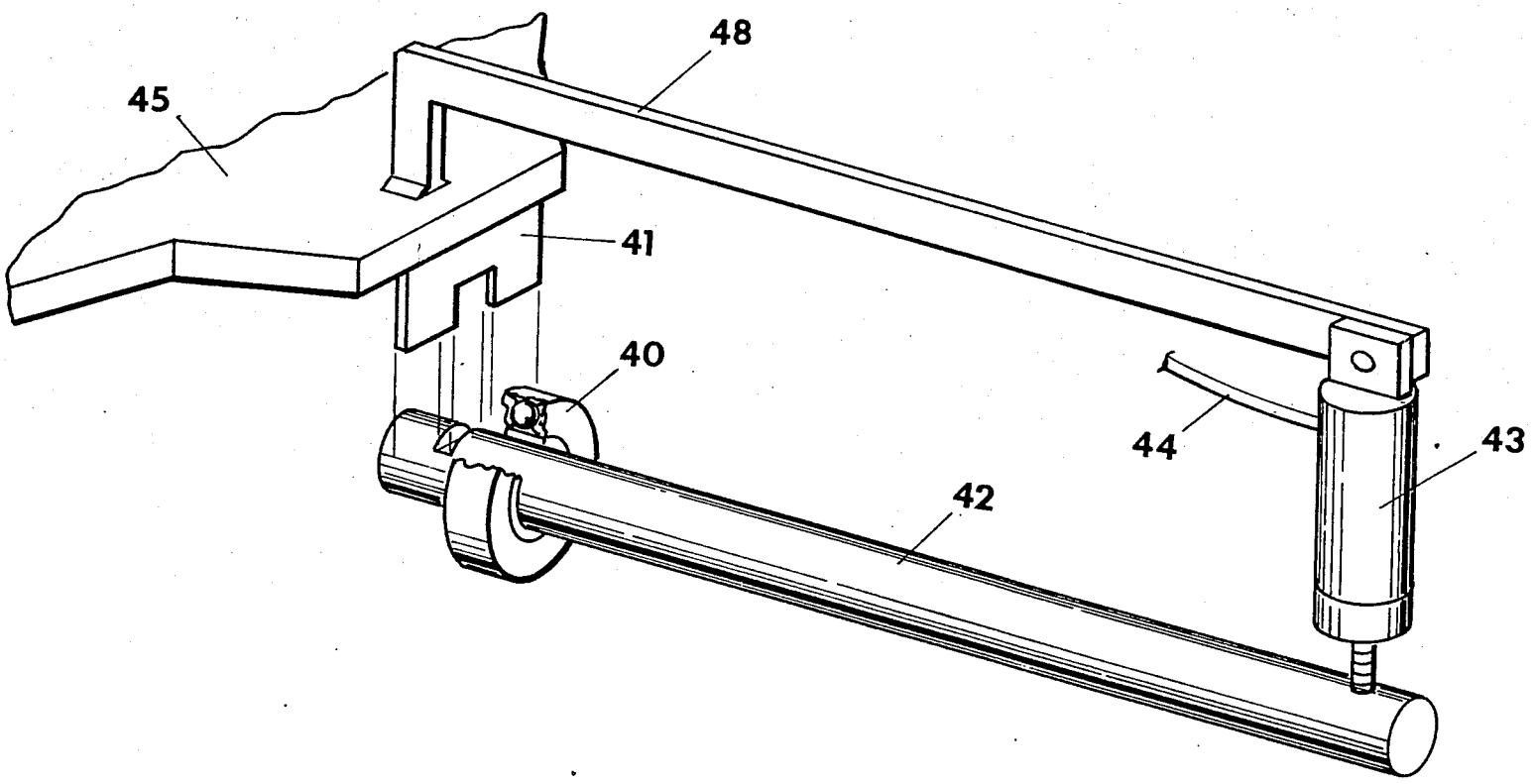

To the rotary table (45), is attached bracket (41) which fits into a groove cut in lever (42), such assembly is more fully shown in FIG. 4. Attached to lever (42) is a wheel (40) which rotates freely on lever (42) and rolls along table (31) in a circular path, and in so doing passes over opening (34) and, by contacting "S" configured lever (30), first drives plunger (25) upward, and then downward due to the "S" configuration of the lever, producing the pumping action. Lever (42) is also connected to rotary table (45) by an angle bracket (48) which is welded to table (45) to which is attached a pneumatic plunger (43) which is connected to lever (42) by a hole (not shown) cut into the lever (42). The pneumatic plunger (43) is forced downward by air pressure supplied through air line (44) from an air reservoir (50) which is permanently attached to rotary table (45). The air pressure remains constant in the reservoir at all times during the operation of the machine.

The foregoing is considered illustrative only of the principles of the invention. Further, since numerous modifications and changes will readily occur to those skilled in the art, it is not desired to limit the invention to the exact construction and operation shown and described, and, accordingly, all suitable modifications and equivalents may beresorted to falling within the scope of the invention.

What is claimed and desired to be secured by Letters patent is:

1. A machine to convert electrical, centrifugal and mechanical energy to produce hydraulic pressure comprising :

a stationary table surface having a rotating vertical shaft extending through a proximate central portion therein;

a rotary table surface connected to the shaft;

at least two sets of pheripherally extending spokes (levers) connected by a hinge connection to an upper portion of the shaft so the spokes are free to oscillate in a generally vertical direction about the hinge connection;

wheels configured in interior and exterior patterns attached to one end of the spokes and being able to rotate freely on the spokes so that when the shaft is turned the wheels roll along the stationary table surface in a circular path or paths;

pneumatic plunger devices connected to each of the spokes for placing downward pressure on another end of the spokes and thus downward pressure on the wheels, each set of spokes being defined by the radial distance from the shaft to the location of the wheels;

a plurality of partially circumferential or circular sectorial slots located on the stationary table surface along the path or paths of the wheels;

generally sinusoidal or composite "S" shaped curved levers extending through the slots for receiving in serial order the passing of each of the wheels over the "S" shaped lever for tending to drive the "S" shaped levers into a rocking motion about a pivotal point of a bearing connected to each of the "S" shaped levers; and hydraulic pumps connected to the bearings and operated in an up and down manner in response to the rocking motion.

2. The apparatus of claim 1 wherein the hydraulic pumps are double action hydraulic pumps that allow hydraulic fluid from a system to pass therethrough on respective upstroke and downstroke of the "S" shaped lever.

3. The apparatus of claim 2 wherein the system includes chambers; a reservoir or supply tank for passing the fluid from the chambers of the system to the pumps, the pumps including chambers for receiving the fluid; and an accumulator for receiving the fluid from the pumps over return lines.

4. The apparatus of claim 2 further comprising unidirectional valves for directively passing the fluid to a hydraulic accumulator.

5. The apparatus of claims 3 or 4 further comprising a hydraulic motor connected to the accumulator for receiving the accumulated fluid and means to return the accumulated fluid passed from an exhaust port of the hydraulic motor to the reservoir or supply tank wherein the means to return the fluid from the hydraulic motor recycles the fluid for use by the system.

6. The apparatus of claim 1 wherein the rotating shaft is mounted on roller bearings.

7. The apparatus of claim 6 further comprising means to drive the table surface at slow speeds.

8. The apparatus of claim 6 wherein the "S" shaped lever is centrally mounted with respect to the length of the lever.

9. The apparatus of claim 1 wherein the apparatus is adaptable to construction is kit form and for use as an educational device.

10. The apparatus of claim 1 wherein the "S" shaped lever is pivotally disposed in an aperture on the table surface.

11. The apparatus of claim 5 wherein the combination of the wheels and the levers and the hydraulic pumps in such that a substantially continuous flow of hydraulic fluid passing to the hydraulic accumulator is generally maintained throughout operation of the motor of the energy machine generating hydraulic energy.

* * * * *